United States Patent [19]

Pink et al.

[11] Patent Number: 4,557,118

[45] Date of Patent: Dec. 10, 1985

[54] CRISPER HUMIDITY CONTROL

[75] Inventors: John J. Pink; Jeffrey L. Prunty, both of Cedar Rapids; Donald Alba, Marengo, all of Iowa

[73] Assignee: Amana Refrigeration, Inc., Amana, Iowa

[21] Appl. No.: 678,917

[22] Filed: Dec. 6, 1984

[51] Int. Cl.[4] ..... F25D 25/02

[52] U.S. Cl. ..... 62/382; 62/408; 62/441

[58] Field of Search ..... 62/382, 441, 408

[56] References Cited

U.S. PATENT DOCUMENTS

| | | | |
|---|---|---|---|
| 2,709,900 | 6/1955 | Zearfoss, Jr. et al. | 62/408 X |
| 3,364,694 | 1/1968 | Cohen et al. | 62/382 X |
| 4,013,434 | 3/1977 | Kronenberger et al. | 62/382 |
| 4,250,719 | 2/1981 | Grimm et al. | 62/382 |

*Primary Examiner*—Lloyd L. King

*Attorney, Agent, or Firm*—William R. Clark; Joseph D. Pannone

[57] ABSTRACT

A refrigerator having a crisper pan with a back passageway that is always open and a front passageway that is adjustable so that the operator can adjust the amount of flow through ventilation to control the humidity in the pan. The lid for the pan also functions as a refrigerator shelf and the back passageway is defined by a gap between the lid and the back of the pan. The front passageway is defined by a front lid plenum having a floor with a plurality of ports. A slide gate positioned in the plenum has a plurality of windows which, by sliding laterally in the plenum, can be made to respectively align with the ports to enable flow through ventilation. Full or partial sealing of the ports is provided by sliding the slide gate laterally to alter the alignment of the windows with the ports.

15 Claims, 6 Drawing Figures

CRISPER HUMIDITY CONTROL

BACKGROUND OF THE INVENTION

Refrigerators generally have one or more pans for storing fresh vegetables and fruit. These pans are commonly referred to as crisper pans and their function is to create a storage environment having higher humidity than the rest of the refrigerator food compartment. Accordingly, in crisper pans, vegetables and particularly moist leafy vegetables do not dry out as they would if stored uncovered in the refrigerated food compartment.

Prior art crisper pans generally have side support lips which slidably engage guide channels or tracks on the underside of a shelf which also functions as a lid for the crisper pan. When a crisper pan is slid to its backward or closed position, the pan is completely sealed underneath the shelf. Accordingly, the dry cold air circulating in the refrigerated food compartment is prevented from flowing through the pan thereby reducing the humidity in the crisper pan. Stated differently, by providing a tight seal for the pan, moisture in the vegetables is prevented from escaping the pan to the rest of the refrigerated food compartment. Some prior art crisper pans have used gaskets to provide a substantially airtight seal.

The prior art shows a recognition that too much moisture in a crisper pan may adversely affect vegetables and fruit. For example, if a large quantity of very moist vegetables is placed in a crisper pan, it is not unusual for the very high humidity in the crisper pan to cause condensation which drips down and forms puddles. It is well known that a soggy condition can cause vegetables to wilt or rot. Accordingly, it is known that it may be desirable to adjust or control the humidity in a crisper pan to a preferable range where the humidity is high enough to prevent vegetables from drying out but is low enough to prevent the formation of condensation and wilting.

One prior art approach to controlling the humidity in a crisper pan utilizes a lid with an inclined rib. Lateral movement of a slide control at the front of the crisper is transformed into forward or backward movement of the lid. In the backward position, an opening exists between the front of the lid and the front wall of the crisper pan; a back opening is created by the rib incline causing the lid to be elevated from the back wall of the crisper pan. Accordingly, the openings at the front and the back of the crisper pan are simultaneously varied in size to alter the amount of dry cold air flowing through the crisper pan. The apparatus of this approach, however, has disadvantages. First, the lid does not also function as a shelf because the operative principle requires that the lid be vertically moveable to adjust the humidity; accordingly, the lid is an extra part that is mounted under the bottom shelf. Not only does this involve extra cost and more complicated fabrication, but it also reduces available refrigerator storage space. Second, the parts and fabrication for an apparatus that transforms movement in one direction to an orthogonal direction is more complicated and expensive than one that does not. Further, it is subject to sticking and breaking.

SUMMARY OF THE INVENTION

In accordance with the invention, there is provided a container for providing a relatively high humidity storage region in a refrigerator compartment, comprising a drawer having a bottom, side walls, a back wall, and a front wall, the top of each of the side walls having a flanged lip, a cover adapted for mounting horizontally in the refrigerator compartment, the cover having slide channels adapted for receiving the lips wherein the drawer is slidably engageable in the slide channels to a closed position underneath the cover, a continuously open passageway into the back of the container in the closed position, and the cover having a shuttered front port for providing an operator controllable front passageway from the container wherein the amount of flow through ventilation of the container between the back and front passageways is operator adjustable. It may be preferable that the back passageway defines a gap between the back wall of the drawer and the cover. Also, the shuttered front port may comprise a port having a laterally slidable gate. Further, it may be preferable that the slidable gate comprise a plate having at least one window adapted for slidably aligning with the port to provide the front passageway. Simply stated, when the size of the front passageway is maximized by aligning the window with the port, flow through ventilation of dry, cold air from the back passageway through the container and out the front passageway removes moisture from the container thereby lowering the humidity.

The invention may also be practiced by a crisper chamber for providing a relatively high humidity storage region in a refrigerator compartment, comprising a crisper pan having a bottom, side walls, a back wall, and a front wall, the side walls having outwardly extending lips, a lid adapted for mounting horizontally in the refrigerator, the lid having parallel side channels for receiving the lips and supporting the crisper pan underneath the lid, the lips of the pan being slidable in the slide channels to a closed position wherein the pan is underneath the lid, the back wall of the pan being spaced from the lid in the closed position defining a continuously open back passageway from the refrigerator compartment into the crisper pan, the lid having a port defining a front passageway from the crisper wherein flow through ventilation of the chamber between the back and front passageways is provided for reducing the humidity in the crisper chamber, and operator actuable means for closing the front passageway to adjust or eliminate the flow through ventilation. Accordingly, the operator can adjust the humidity in the crisper pan to a range which is high enough to prevent drying out of vegetables and fruits and low enough to prevent extreme condensation causing puddles and wilting of the vegetables and fruits. It may be preferable that the lid define a horizontal shelf for supporting objects in the refrigerator compartment. Also, the closing means may define a laterally slidable gate having windows which are adapted for slidably aligning with ports to optimize the size of the front passageway.

The invention also may define a refrigerator comprising a refrigerated food compartment comprising side walls, a back wall, a floor, a ceiling and a front door, means for introducing cold air through the back wall into the food compartment, a high humidity chamber for storing food within the refrigerated food compartment, the chamber comprising a horizontal shelf having parallel front-to-back guide channels on the underside, the chamber further comprising a pan having parallel rims with flanges for slidably engaging the guide channels, the pan being slidable in the channels between a back closed position underneath the shelf wherein the shelf provides a cover for the pan and a front open position used for accessing the interior of the pan from its top side, the chamber having a continuously open passageway at the back communicating from the refrigerated food compartment to the chamber when the pan is in the closed position, the shelf having a passageway at the front wherein some of the cold air flows through the back passageway, through the chamber and out the front passageway thereby removing moisture from the chamber, and means for adjusting the size of the front passageway independently from the back passageway to change the amount of the cold air flowing through the chamber. It may be preferable that the front passageway define a plenum between the chamber and the compartment, the plenum having a port communicating with the compartment, the adjusting means comprising a lateral slide gate for sealing the port. Also, it may be preferable that the shelf have a lateral rib extending down behind the back of the pan, the back passageway comprising a space between the rib and the back of the pan.

Also, the invention may be practiced by a refrigerator comprising a refrigerated food compartment, a crisper pan having a bottom, side walls, a back wall and a front wall, each of the side walls having a flanged lip, a shelf horizontally mounted in the refrigerated food compartment, the shelf having a pair of underside front-to-back slide channels for slidably receiving the flanged lips wherein the crisper pan is suspended underneath and covered by the shelf in a closed position, the back wall of the pan being spaced from the shelf in the closed position providing a continuously open back passageway for the cold air to flow into the pan, the shelf having a front plenum communicating with the interior of the pan, the plenum having at least one horizontal port communicating to the refrigerated food compartment thereby defining passageway from the front of the pan through the plenum and into the refrigerated food compartment by way of the port, and an operator actuable horizontal slide shelf for opening and closing the port.

In accordance with the invention, there is provided a crisper pan humidity control that leaves open a passageway at the rear of the pan and only adjusts a front passageway. It has been found that high humidity can be maintained because flow through ventilation is prevented by sealing the front and the continuously open passageway is at the back. Accordingly, because of the air current flow in the refrigerator compartment, very little moisture migrates from the open back passageway. The invention has significant advantage over the prior art approach of simultaneously adjusting both the front and back passageway because there is no front-to-back mechanical linkage required. More specifically, fewer parts are required and a lateral slide can be used which is not subject to sticking or breaking. Also, because the lid is stationary, it can also be used as a shelf.

BRIEF DESCRIPTION OF THE DRAWINGS

The foregoing advantages will be more fully understood by reading the Description of the Preferred Embodiment with reference to the drawings wherein.

DESCRIPTION OF THE PREFERRED EMBODIMENT

Figure 1:
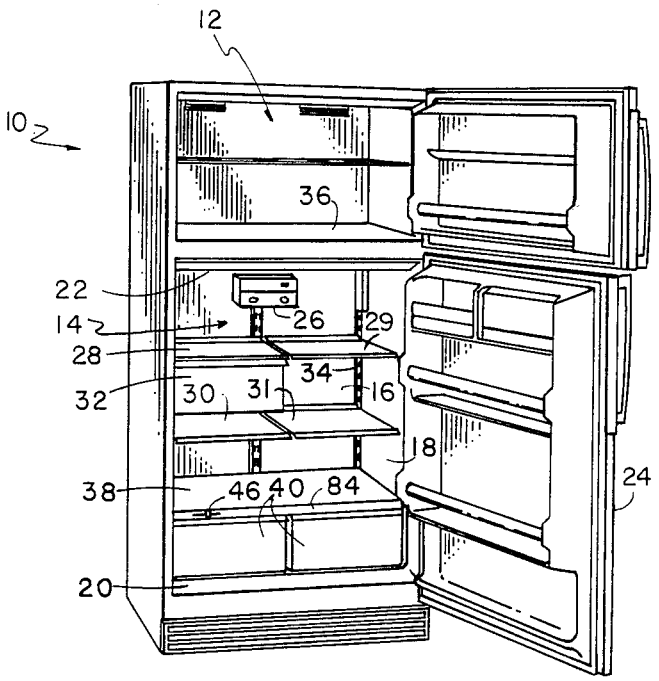
FIG. 1 is a front perspective view of a refrigerator.

Referring to FIG. 1, a front perspective view of a refrigerator 10 is shown. Although refrigerator 10 is here shown top mounted with freezer compartment 12 mounted above refrigerated food compartment 14, the invention has advantage with other refrigerator configurations. Refrigerated food compartment 14 is defined by back wall 16, side walls 18, floor 20, ceiling 22 and door 24. Operator temperature control 26 is mounted on back wall 16 and cold air is introduced into refrigerated food compartment 14 from the underside thereof. As is conventional, the air entering from operator temperature control 26 generally descends down to floor 20 because, having just passed across the evaporator (not shown), it is cooler than the air present in refrigerated food compartment 14. The cold air flows around shelves 28–31 if they are solid or through them if they are wire shelves. Shelf 28 here supports a conventional meat keeper 32 and therefore would generally be a solid shelf. As shown, shelves 28–31 are supported in cantilever fashion from brackets 34 although other suitable mounting structure could be used. Generally, the cold air having descended predominantly down the back wall 16 of refrigerated food compartment 14 flows forward and up along door 24 and is then drawn into partition 36 by a fan (not shown) for completing the recirculation loop back to the evaporator.

Figure 3:
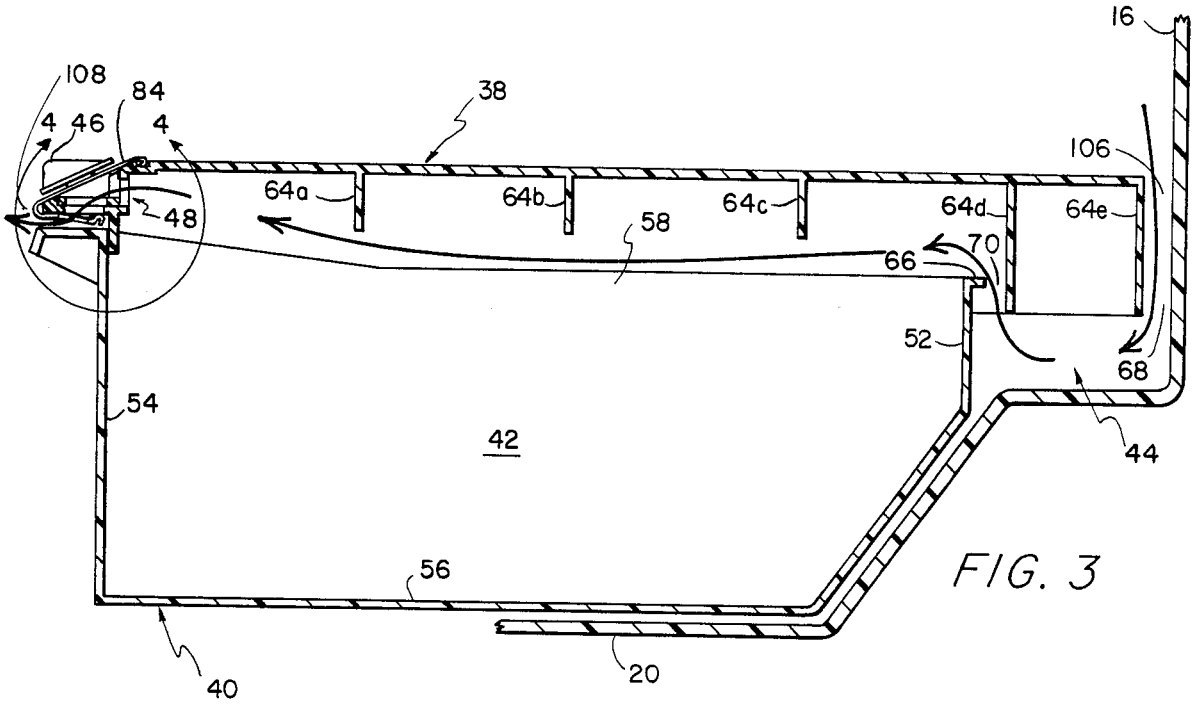
FIG. 3 is a side sectioned view of a crisper.

Horizontally mounted shelf 38 is of solid construction because it provides a cover for sealing the top of side-by-side crisper pans 40 thereby defining crisper chambers 42 (FIG. 3). In accordance with the invention and as will be described in detail later herein, slide knob 46 is used to control or adjust a front passageway 48 (FIG. 4) which communicates from at least one of the chambers 42 to the front of refrigerated food compartment 14.

Figure 2:
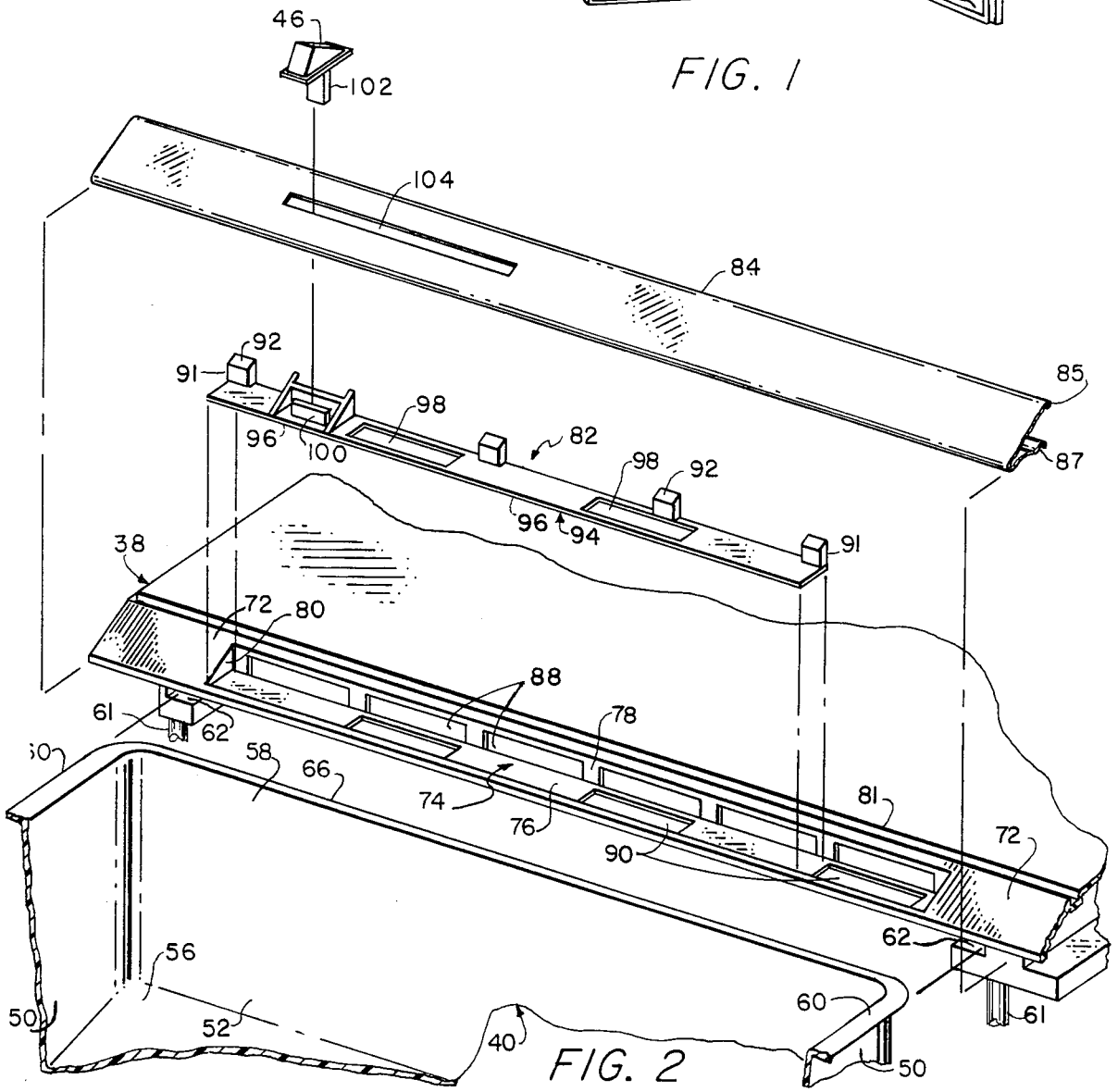
FIG. 2 is a front perspective exploded view of FIG. 4.
Figure 4:
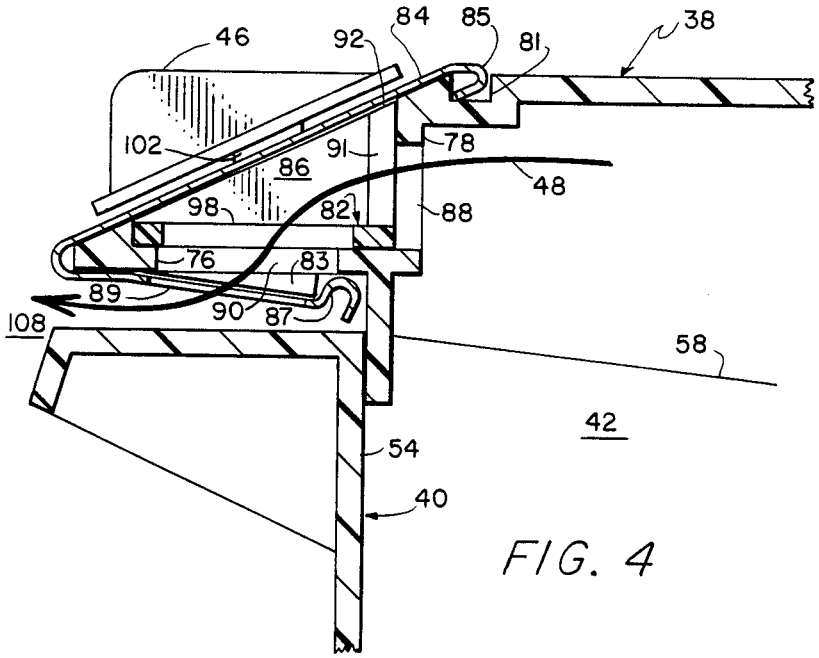
FIG. 4 is an expanded view of line 4—4 of FIG. 3.

Referring to FIG. 3, a side sectional view of one of the crisper chambers 42 is shown. FIG. 4 is an expanded view of the region enclosed by line 4—4 of FIG. 3. Reference is also made to FIG. 2 which shows an exploded front perspective view of FIG. 4. Crisper pan 40 or drawer which may conventionally be fabricated of metal or molded plastic is a generally rectangular box and has side walls 50, a back wall 52, a front wall 54 and a bottom 56. The top 58 is open for access. Side walls 50 are bent or formed outwardly to provide lips 60 or flanges from which pan 40 is slidably supported. As shown in FIG. 3, the back wall 52 of pan 40 may be truncated to conform with the back wall 16 or liner of refrigerated food compartment 14. As is conventional, shelf 38, which also functions as a cover for pan 40, is solid as contrasted to a wire shelf so that it substantially seals the top 58 of pan 40. Typically, shelf 38 is a molded plastic part. Shelf 38 is mounted by suitable means such as metal posts 61 at the bottom of refrigerated food compartment 14. As is conventional, shelf 38 has a pair of parallel slide channels 62 or guide grooves running from front to back. Slide channels 62 are adapted for receiving the flanged lips 60 of pan 40 which can then be slid backwardly to the closed or storage position as shown in FIG. 3. Access, of course, is provided by sliding pan 40 forwardly from the closed position.

As shown best in FIG. 3, shelf 38 has a plurality of lateral underside ribs 64*a–e* that provide structural support. At least one back rib, here shown as ribs 64*d* and 64*e*, extends down below the upper edge 66 of pan 40 in the closed position. Further, there is a space 68 or gap between the back rib 64*e* and the back wall 16 of the refrigerated food compartment 14. Also, there is a space 70 or gap between the back wall 52 of pan 40 and shelf 38 or, more specifically, in the embodiment shown, the closest adjacent rearward rib 64*d*. Accordingly, there is a back passageway 44 from the refrigerated food compartment 14 into chamber 42 that is continuously open when pan 40 is in the closed position. As shown by air flow arrows in FIG. 3, back passageway 44 is through space 68 and space 70. The smallest constriction of back passageway 44 may preferably have a cross-section of approximately 3 square inches.

As shown best in FIG. 2, the front surface 72 of shelf 38 is inclined and has a notch 74 or hollow defining a floor 76 or platform, a side wall 78 and ends 80. Side wall 78 has a plurality of apertures 88 which communicate with chamber 42. Also, floor 76 has a plurality of spaced rectangular ports 90. Slide gate 82 or shutter which is preferably a plastic molded part seats on floor 76 and casing 84 or partition clips over front surface 72 thereby enclosing notch 74 to define a plenum 86. Specifically, the top of shelf 38 may have a groove 8 and the underside edges may have ramps 83 which are adapted for receiving the respective edges 85 and 87 of casing 84. Further, the underside of casing 84 is open or has a plurality of openings 89 which align with ports 90 so as not to impede the flow of air therethrough.

As will be described later herein, slide gate 82 functions to open and close front passageway 48 through ports 90. Accordingly, slide gate 82 has a horizontal plate 94 with a plurality of windows 98 which are sized and spaced so as to overlay ports 90 in one lateral slide position of slide gate 82. Further, shutter regions 96 between windows 98 are shaped and spaced such that in another lateral slide position, they cover ports 90 thereby blocking front passageway 48. Slide gate 82 further has a plurality of vertical posts 91 or columns with inclined tops 92 adapted for seating against casing 84 so as to prevent slide gate 82 from riding upwardly in plenum 86. Stated differently, posts 91 keep horizontal plate 94 firmly seated against floor 76. Also, slide gate 82 has a fastener 100 suitable for connecting to a neck 102 of slide knob 46. Neck 102 inserts through slot 104 in casing 84. Accordingly, by pushing slide knob 46 laterally along slot 104, slide gate 82 can be made to move laterally within plenum 86.

Figure 5:
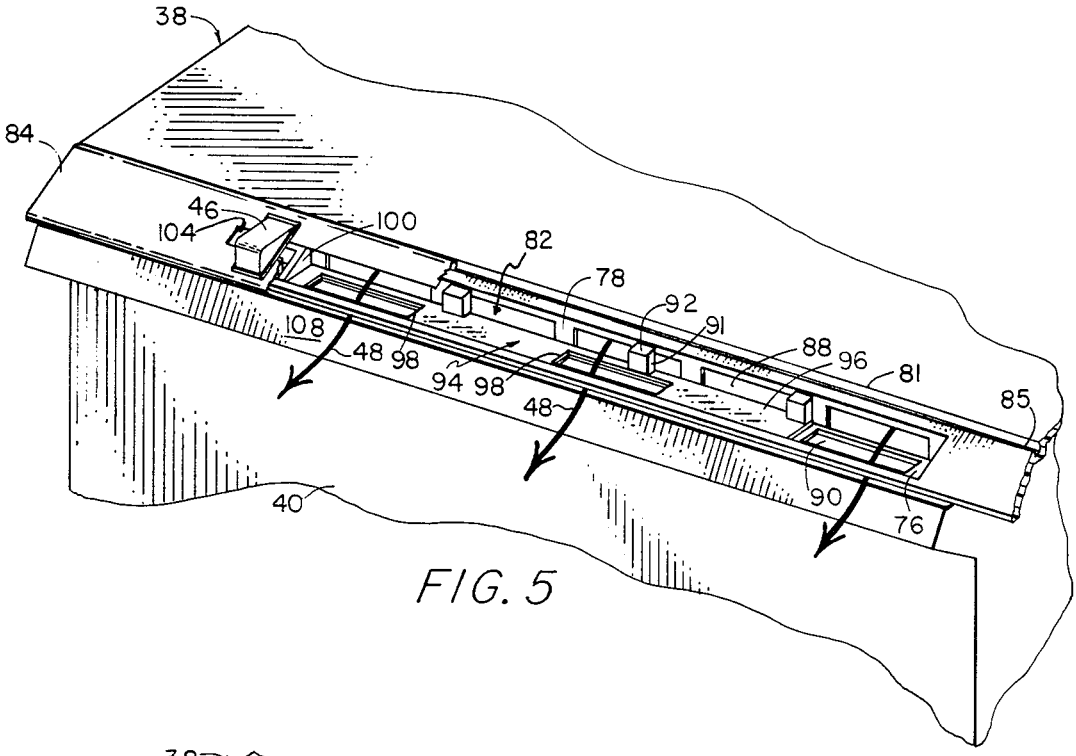
FIG. 5 is a partially broken away view showing the front passageway of the crisper.
Figure 6:
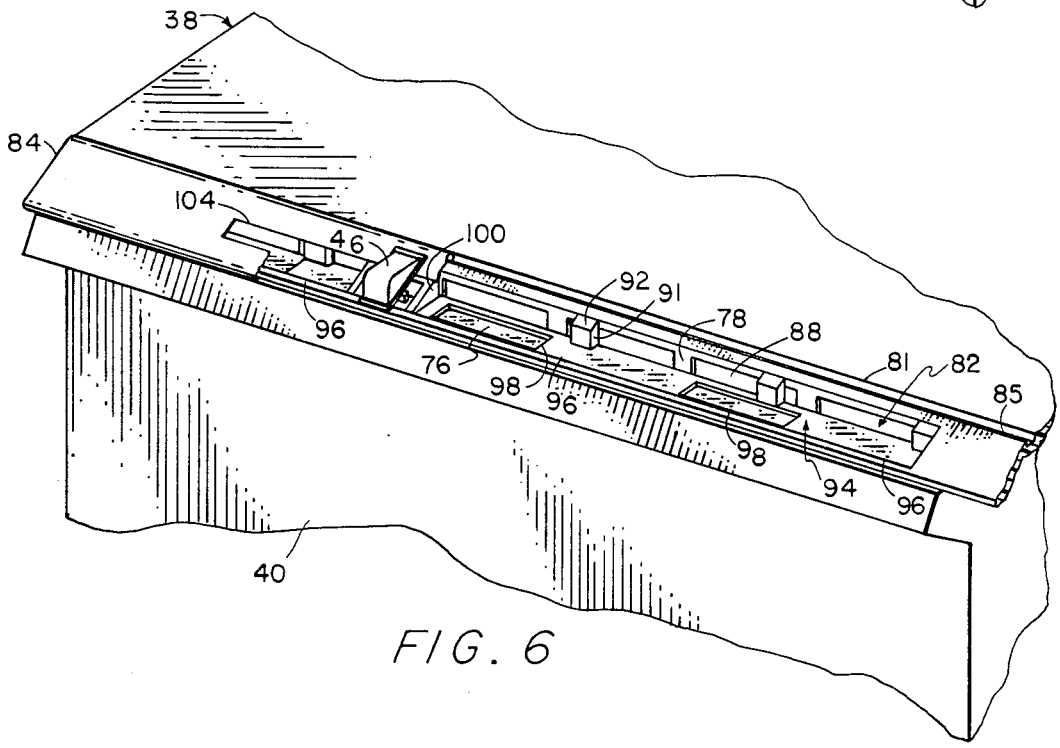
FIG. 6 is a view of the passageway of FIG. 5 in the closed position.

Referring to FIGS. 5 and 6, there are partially broken away views respectively showing open and closed operating positions of slide gate 82. Horizontal plate 94 of slide gate 82 is depicted having two windows 98 with shutter regions 96 at both ends and in the middle. With slide gate 82 in the left or open position as shown in FIG. 5, the two windows 98 align with the two left ports 90 in floor 76 and horizontal plate 94 does not extend over the right port 90 as shown so it remains uncovered. Accordingly, in this open position, front passageway 48 from chamber 42 to the front of refrigerated food compartment 14 is open for the passage of air as shown by the air flow arrows. More specifically, front passageway 48 leads from chamber 42 through apertures 88 into plenum 86 and then through uncovered ports 90 downward to the front of refrigerated food compartment 14. In operation, the operator uses slide knob 46 to push slide gate to the open position shown in FIG. 5 when relatively low humidity is desired in chamber 42. In this operative configuration, cold dry air descending down back wall 16 from temperature control 26 creates a very slight positive pressure at the outside entrance 106 of back passageway 44. This pressure causes the cold air to migrate or flow through chamber 42 by entering back passageway 44 and exhausting from front passageway 48 thereby removing moisture from chamber 42. Air currents rising up along door 24 in its normal circulation path through refrigerated food compartment 14 also assists in drawing air out of front passageway 48. More specifically, the upward flow along door 24 helps prevent a static pressure build-up at the outlet 108 of front passageway 48.

In operation, the operator uses slide knob 46 to push slide gate 82 to the closed position as shown in FIG. 6 when relatively high humidity is desired in crisper chamber 42. In this operative configuration, front passageway 48 is blocked off while the back passageway 44 remains open or unchanged. More specifically, shutter regions 96 slide over ports 90 thereby covering them. Although apertures 88 remain open and communicate from chamber 42 to plenum 86, the outward flow of air from plenum 86 to the front of the refrigerated food compartment 14 through ports 90 is blocked by the shutter regions 96 of slide gate 82. Stated differently, the windows 98 do not align with the ports 90. It has been found that by closing off front passageway 48, the humidity in chamber 42 remains relatively high even though back passageway 44 remains open. Part of the reason for this may be that it is the back passageway 44 as contrasted to the front passageway 48 which is left open and the moisture tends not to migrate out of chamber 42 because the cold dry air is descending down back wall 16 towards the outside entrance 106 to back passageway 44. Also, it is noted that ribs 64*d* and 64*e* extend down below upper edge 66 of pan 40 thereby providing a slightly positive pressure at space 70. It is apparent that slide gate 82 can be laterally positioned such that windows 98 partially align with ports 90 to provide intermediate flow through ventilation between the maximum and minimum levels corresponding respectively to FIGS. 5 and 6.

This completes the Description of the Preferred Embodiment. A reading of it by those skilled in the art will bring to mind many alterations and modifications without departing from the spirit and scope of the invention. For example, although plenum 86 is described as having three rectangular ports 90 out to the front of the refrigerated food compartment 14, other numbers and shapes of ports could be used. Also, although the slide gate 82 was depicted and described as having two windows 98 for aligning with ports 90, the horizontal plate 94 could be extended over to an adjacent chamber 42 whereby the relative humidity of two chambers 42 would be controlled by slide knob 46. Alternately, each chamber 42 could have its own individual slide gate 82 and slide knob 46. Accordingly, it is intended that the scope of the invention only be limited by the appended claims.

What is claimed is:

1. A container for providing a relatively high humidity storage region in a refrigerator compartment, comprising:

a drawer having a bottom, side walls, a back wall, and a front wall, the top of each of said side walls having a flanged lip;

a cover adapted for mounting horizontally near the bottom of said refrigerator compartment, said cover having underside parallel slide channels for receiving said lips wherein said drawer is slidably engageable in said slide channels to a closed position underneath said cover;

said cover extending rearwardly past said back wall of said drawer in said closed position;

a continuously open passageway under said cover into the back of said container for receiving natural convection air from said refrigerator compartment in said closed position; and said cover having a shuttered front port for providing an operator controllable front passageway from said container wherein the amount of flow-through ventilation of said natural convection air through said container between said back and front passageways is operator adjustable.

2. The container recited in claim 1 wherein said cover has a lateral rib extending down behind the top of said back wall of said drawer, said continuously open back passageway passing through the space between said rib and said back wall of said drawer.

3. The container recited in claim 2 wherein there is a gap between said back wall of said drawer and a horizontal section of said cover, said continuously open back passageway also passing through said gap.

4. The container recited in claim 1 wherein said shuttered front port comprises a horizontal port having a laterally slidable gate comprising a horizontal plate having at least one window adapted for slidably aligning with said port to provide said front passageway.

5. A crisper chamber for providing a relatively high humidity storage region in a refrigerator compartment, comprising:

a crisper pan having a bottom, side walls, a back wall, and a front wall, said side walls having outwardly extending lips;

a lid adapted for mounting horizontally near the bottom of said refrigerator, said lid having parallel underside slide channels for receiving said lips and supporting said crisper pan underneath said lid;

said lips of said pan being slidable in said slide channels to a closed position wherein said pan is underneath said lid;

said back wall of said pan being spaced from said lid in said closed position defining a continuously open back passageway from said refrigerator compartment into said crisper chamber for receiving natural convection air;

said lid having a front passageway from said crisper chamber wherein flow-through ventilation of said natural convection air through said chamber from said back passageway to said front passageway is provided for reducing the humidity in said crisper chamber;

said front passagway comprising a plenum in said lid between said chamber and said compartment, said plenum having a horizontally disposed port communicating from said plenum to said compartment; and operator actuable means for closing said front passageway to adjust or eliminate said flow-through ventilation of said natural convection air, said closing means comprising a laterally slidable gate for sealing said port.

6. The chamber recited in claim 5 wherein said lid defines a horizontal shelf for supporting objects in said refrigerator compartment.

7. The chamber recited in claim 5 wherein said slidable gate comprises a plate having at least one window adapted for slidably aligning with said port to provide said front passageway.

8. A refrigerator comprising:

a refrigerated food compartment comprising side walls, a back wall, a floor, a ceiling and a front door;

means for introducing cold air into said food compartment adjacent to said ceiling through said back wall, said cold air flowing down along said back wall and up along said front door by natural convection;

a high humidity chamber positioned adjacent to said floor for storing food within said refrigerated food compartment, said chamber comprising a horizontal shelf having parallel underside front-to-back guide channels;

said chamber further comprising a pan having parallel rims with flanges for slidably engaging said guide channels, said pan being slidable in said channels between a back closed position underneath said shelf wherein said shelf provides a cover for said pan and a front open position used for accessing the interior of said pan from its top side;

said chamber having a continuously open back passageway communicating from said refrigerated food compartment to said chamber when said pan is in said closed position for receiving said natural convection air;

said shelf having a front passageway for providing flow through ventilation of said chamber by said natural convection air flowing in said back passageway and out said front passageway, said flow through ventilation removing moisture from said chamber; and means for adjusting the size of said front passageway independently from said back passageway to control said flow through ventilation of said chamber.

9. The refrigerator recited in claim 8 wherein said adjusting means comprises means for sealing said front passageway.

10. The refrigerator recited in claim 8 wherein said back passageway defines a gap between said back wall of said pan and said shelf in said closed position.

11. The refrigerator recited in claim 8 wherein said front passageway defines a plenum between said chamber and said compartment, said plenum having a horizontal port communicating with said compartment, said adjusting means comprising a lateral slide gate for sealing said port.

12. The refrigerator recited in claim 8 wherein said shelf has a lateral rib extending down behind the back of said pan, said back passageway comprising a space between said rib and said back of said pan.

13. A refrigerator comprising:

a refrigerated food compartment comprising side walls, a back wall, a floor, a ceiling and a front door;

means for introducing cold air into said food refrigerated food compartment adjacent to said ceiling through said compartment back wall, said cold air flowing down along said compartment back wall and up along said front door by natural convection;

a crisper pan having a bottom, side walls, a back wall and a front wall, each of said pan side walls having a flanged lip;

a shelf horizontally mounted in said refrigerated food compartment adjacent to said floor, said shelf having a pair of underside front-to-back slide channels for slidably receiving said flanged lips wherein said crisper pan is suspended underneath and covered by said shelf in a closed position;

said back wall of said pan being spaced from said shelf in said closed position providing a continuously open back passageway for receiving said natural convection air;

said shelf having a front plenum communicating with the interior of said pan, said plenum having at least one horizontal port communicating to said refrigerated food compartment thereby defining a front passageway from said pan through said plenum and into said refrigerated food compartment by way of said port wherein said natural convection air flows into said pan through said back passageway and out of said pan through said front passageway; and an operator actuable horizontal slide shutter for opening and closing said port to control the flow through ventilation of said pan.

14. The refrigerator recited in claim 13 wherein said shelf has a lateral rib extending down behind said back wall of said pan.

15. The refrigerator recited in claim 13 wherein said plenum has a plurality of ports communicating to said refrigerated food compartment and wherein said slide shutter has a plurality of windows adapted for respectively aligning with said ports in one slide position of said slide shutter.

* * * * *